US006041587A

United States Patent [19]

Gabalda et al.

[11] Patent Number: 6,041,587

[45] Date of Patent: Mar. 28, 2000

[54] MACHINE FOR MAKING A MIXED YARN BY COMBINING TWO FALSE-TWIST TEXTURED YARNS

[75] Inventors: Carlos Matas Gabalda, Granges les Valence; Jean-Claude Dupeuble, Saint-Genis Laval, both of France

[73] Assignee: ICBT Yarn, Roanne, France

[21] Appl. No.: 09/077,979

[22] PCT Filed: Feb. 14, 1997

[86] PCT No.: PCT/FR97/00289

§ 371 Date: Jun. 12, 1998

§ 102(e) Date: Jun. 12, 1998

[87] PCT Pub. No.: WO97/31141

PCT Pub. Date: Aug. 28, 1997

[30] Foreign Application Priority Data

Feb. 20, 1996 [FR] France ..... 96.02292

[51] Int. Cl.[7] ..... D02G 1/02

[52] U.S. Cl. ..... 57/333; 57/86; 57/284; 57/290; 57/291; 57/328; 57/313; 57/289; 57/351

[58] Field of Search ..... 57/351, 91, 284, 57/289, 290, 332, 333, 334, 339, 352; 28/328, 252, 279

[56] References Cited

U.S. PATENT DOCUMENTS

| | | | |
|---|---|---|---|
| 4,164,836 | 8/1979 | Tanae et al. . | |
| 4,395,872 | 8/1983 | Riedl | 57/291 |
| 4,446,690 | 5/1984 | Warner . | |
| 4,467,594 | 8/1984 | Eschenbach . | |
| 4,581,883 | 4/1986 | Streppel | 57/290 |
| 5,163,279 | 11/1992 | Stahlecker | 57/86 |
| 5,203,157 | 4/1993 | Stahlecker | 57/313 |

FOREIGN PATENT DOCUMENTS

| | | |
|---|---|---|
| 669597 | 3/1966 | Belgium . |
| 2459847 | 6/1979 | France . |
| 2619127 | 8/1987 | France . |
| 2621332 | 10/1987 | France . |
| 27 16 106 | 10/1977 | Germany . |

*Primary Examiner*—William Stryjewski
*Assistant Examiner*—Mary K. Fiore
*Attorney, Agent, or Firm*—Wall Marjama Bilinski & Burr

[57] ABSTRACT

A machine for making a mixed yarn by combining two false-twist textured yarns is disclosed. The machine comprises drawing systems (3A, 3B; 8A, 8B) arranged on either side of the texturing area and mounted alternately on two separately controlled parallel, shafts, and heat treatment units (5A, 5B) located in the false twisting area and having a temperature controlled by two mutually separated systems. The false-twist spindles (7) are power spindles with a speed that may be varied to suit each kind of yarn. The machine comprises joining device (9) for interlacing two yarns from two different texturing positions, the device being arranged, when seen from the front, between the positions so that the two yarns (2A, 2B) follow identical paths before being joined.

6 Claims, 4 Drawing Sheets

MACHINE FOR MAKING A MIXED YARN BY COMBINING TWO FALSE-TWIST TEXTURED YARNS

BACKGROUND TO THE INVENTION

It was proposed long ago, as is apparent for example from U.S. Pat. No. 4,467,594, to produce composite yarns by assembling two yarns textured by false twisting by means of a nozzle placed downstream of the false-twisting zone.

In order to produce such yarns, texturing machines of the type illustrated by the appended FIG. 1 are used, these being composed of a plurality of identical work positions which are arranged side by side on a support frame, preferably symmetrically with respect to a central axis YY and in a similar manner to the teachings of FR-A-2,459,847 and FR-A-2,619,127.

In such a machine, each work position includes a supply (1) of the yarn (2) to be treated, consisting of yarn supports mounted on a creel, this element not being shown in FIG. 1.

Each work position comprises, downstream of this supply, in the order of treatment:

- a first forwarder (or pull-off) (3) of known type, for example of the strap-type, capstan-type or equivalent;
- guide elements (4) allowing the yarn to be transported into a first heater (5) preferably consisting of an open oven which is used for simultaneously treating two yarns in parallel;
- a cooling zone (6) for the yarn leaving the oven (5);
- a false-twisting spindle (7);
- a second pull-off (8) for the textured yarn leaving the false-twisting zone proper;
- a commingling nozzle (9) followed by a third pull-off (10), two yarns coming from two different positions being taken into the commingling nozzle (9) so as to form a composite yarn (11);
- a heat-treatment zone (12) for the composite yarn (11); and
- guide elements (13) followed by a fourth pull-off (14) delivering the composite yarn (11) to the wind-up means (15).

Although such a type of apparatus enables composite yarns consisting of two individual yarns of the same kind, for example two polyester yarns together, two polyamide yarns, etc., to be easily produced, it is not, on the other hand, suitable when it is desired to produce composite yarns from individual yarns of a different nature, for example a composite yarn consisting of a polyamide yarn and of a yarn of another kind. This is because it is well known that, for each type of yarn, the texturing conditions are different, especially with regard to the temperature of the oven (5) which comes before the texturing spindle (7) and the amount of twist imparted by the spindle during the texturing operation.

Consequently, when it is desired to produce such yarns, one of the faces of the machine is generally set for treating one type of yarn, the other face a second type of yarn, and yarns are combined in the nozzle (9) by making a yarn treated on one face pass through the frame of the machine in order to transport it into the assembling zone, this assembling being carried out on the other face, thereby resulting in a tricky operation.

Now, a novel type of machine has been found, and it is this that forms the subject of the present invention, which allows such composite yarns, which may either be regular or, optionally, provide effects along their length, such as, for example, visible loops, slubs, etc., to be easily produced.

In a general manner, the machine according to the invention allowing production of a composite yarn by assembling two yarns textured by false twisting is composed, in a known manner, of a plurality of identical work positions which are arranged side by side on a support frame and supplied with yarns from wound packages mounted on a rack or creel, each position comprising, downstream of this supply, in the order of treatment:

- a false-twist texturing zone comprising a first forwarder or pull-off, guide elements enabling the yarn to be transported into a heater, a cooling zone, a false-twisting spindle and a second pull-off for the textured yarn leaving the false-twisting zone proper;
- a zone enabling the two yarns textured at two adjacent positions to be assembled, said zone consisting of a commingling nozzle followed by a third pull-off downstream of which a second heat-treatment zone for the composite yarn is advantageously placed, on the output side of which zone the guide elements associated with a fourth pull-off enable the composite yarns to be delivered to the wind-up means.

SUMMARY OF THE INVENTION

The machine according to the invention is one in which:

- the yarn pull-off systems placed on each side of the texturing zone are mounted alternately on two parallel shafts which are controlled independently of each other;
- the heat-treatment ovens of the false-twisting zone are temperature-controlled by two systems independent of each other;
- the false-twisting spindles are advantageously motor-driven, enabling their speed to be varied depending on the nature of the yarns;
- the joining means for commingling the two yarns coming from two different texturing positions are placed, seen from the front, between said positions, enabling the two yarns to have an identical path before they are joined together.

According to a preferred embodiment of a machine in accordance with the invention, in which the false-twisting ovens are open ovens enabling two yarns to be treated in parallel, the pull-offs of the false-twist zone are offset in pairs.

By virtue of such a design of the machine, it is therefore possible to treat yarns having different characteristics, for which the texturing conditions (temperature, speed of the spindles, etc.) are not identical, on the same face of the machine.

Moreover, such a machine can be used either to produce regular composite yarns or novelty yarns, such as loop yarns, slub yarns, etc., by feeding, for example, one of the two constituents at greater rate than the other and/or by providing upstream of the joining zone, upstream or downstream of the forwarders placed on the output side of the texturing zone, additional means making it possible to establish a temporary accumulation of one or other of the yarns and/or to vary the tension or the delivery rate of the said individual yarns one with respect to the other.

Finally, although such a machine is particularly suitable for producing assemblies consisting of two individual yarns, it is conceivable, optionally, to use the machine for producing single, textured and/or commingled yarns, as well, as optionally, composite yarns consisting of more than two individual yarns.

BRIEF DESCRIPTION OF THE DRAWINGS

The invention, together with the advantages which it provides, will, however, be more clearly understood by virtue of the specific exemplary embodiment given below by way of indication but implying no limitation, this embodiment being illustrated by the appended diagrams in which.

DESCRIPTION OF THE INVENTION

In the rest of the description, the same references will be used to denote the same elements, but indices A and B are added to them in order to distinguish the two types of treated yarns.

Figure 1:
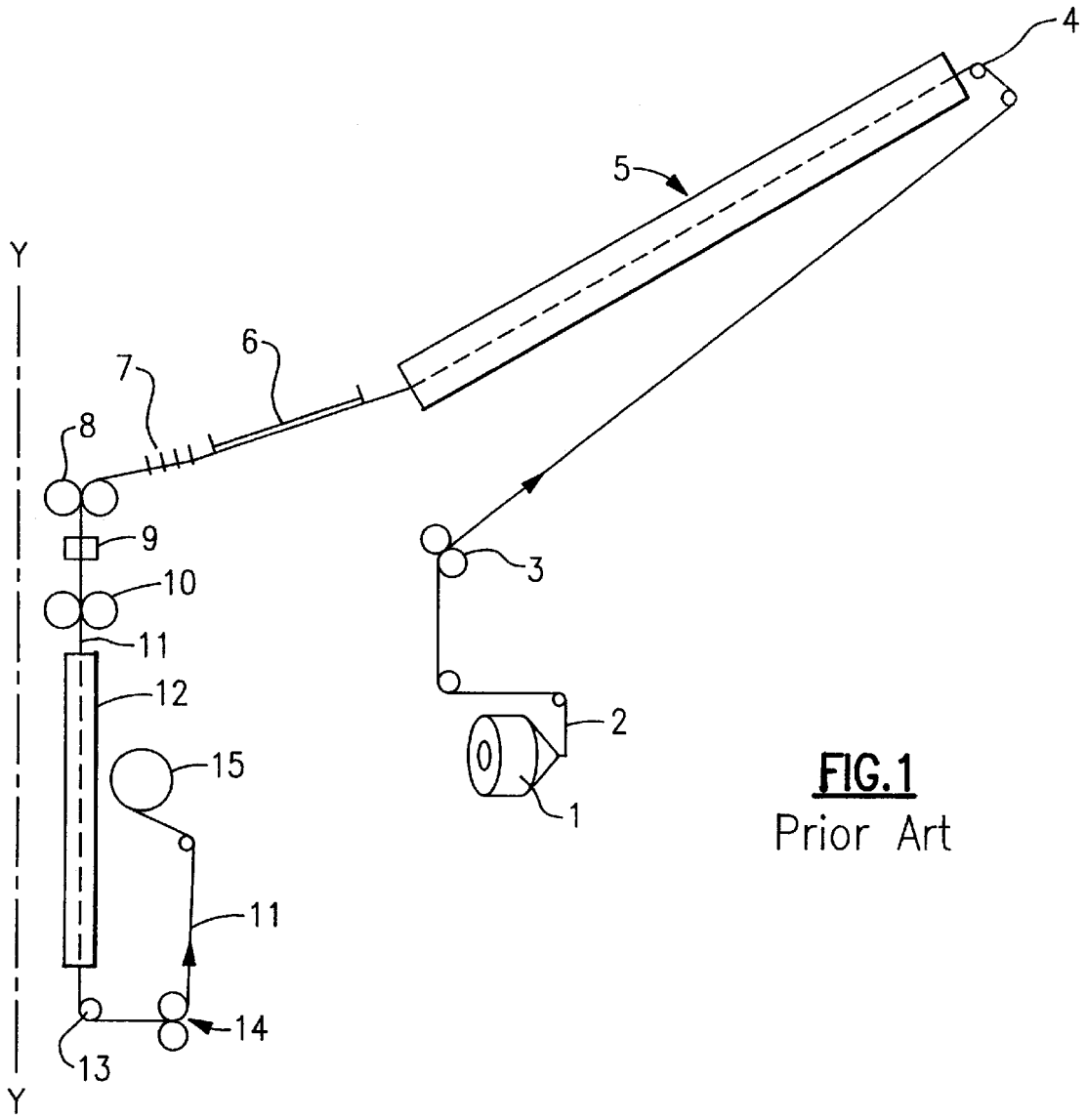
FIG. 1 Prior Art
FIG. 1 illustrates, as mentioned previously, a conventional false-twist texturing and commingling machine.
Figure 2:
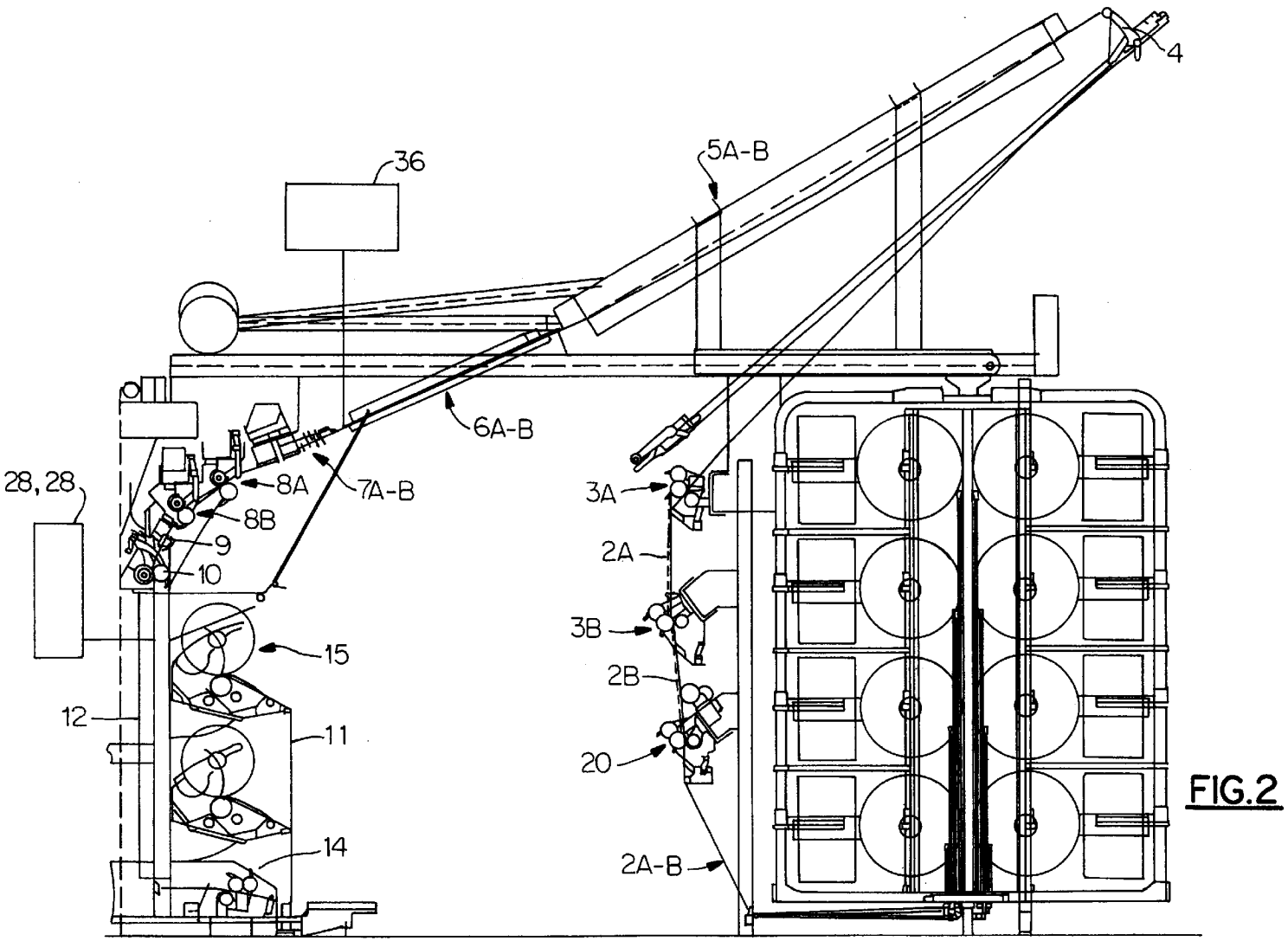
FIG. 2 is a side view of a work position of a machine according to the invention.
Figure 3:
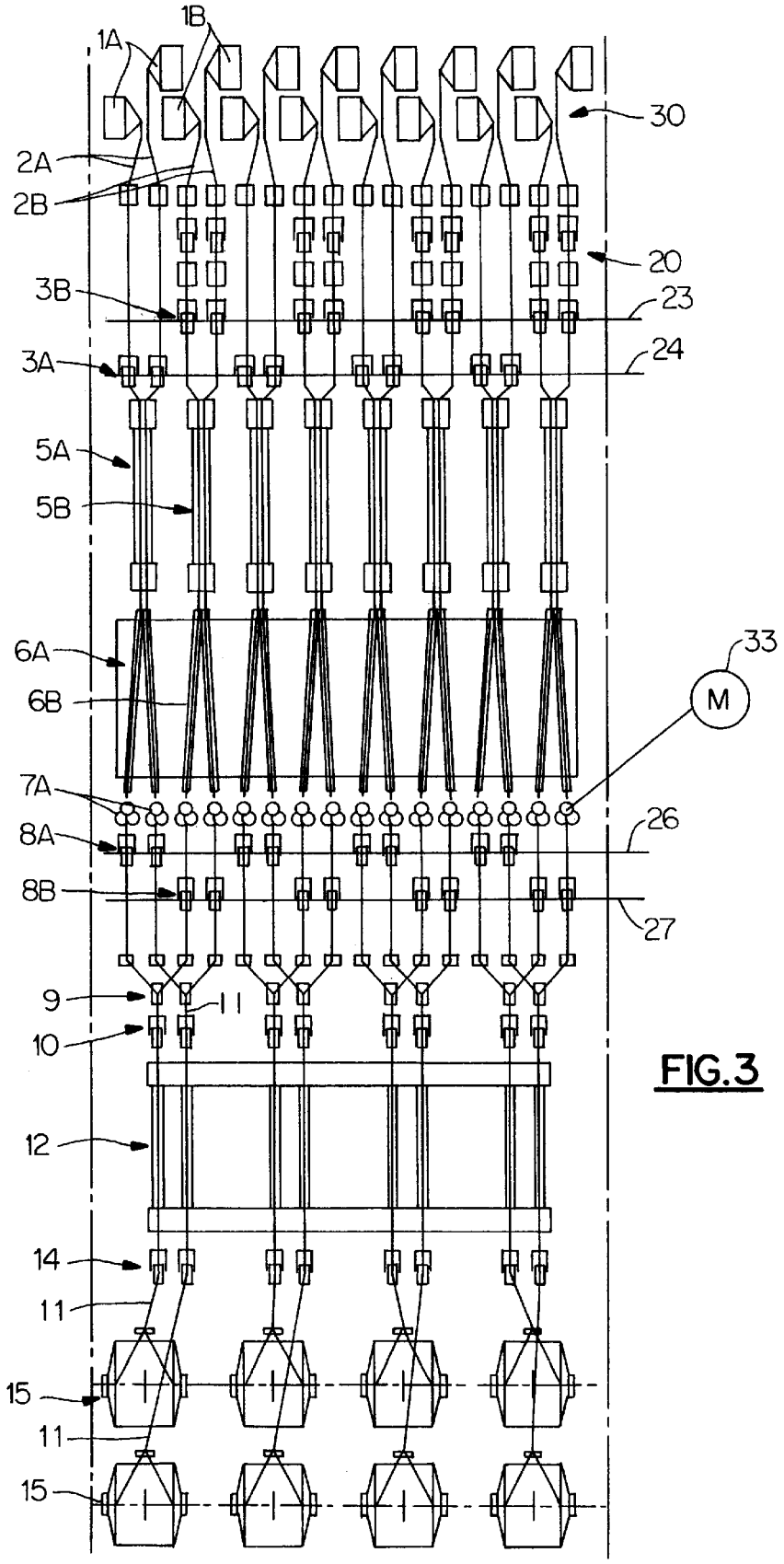
FIG. 3 is a flat view showing the structure and positioning of the various members of a machine according to the invention used for producing assemblies.
Figure 4:
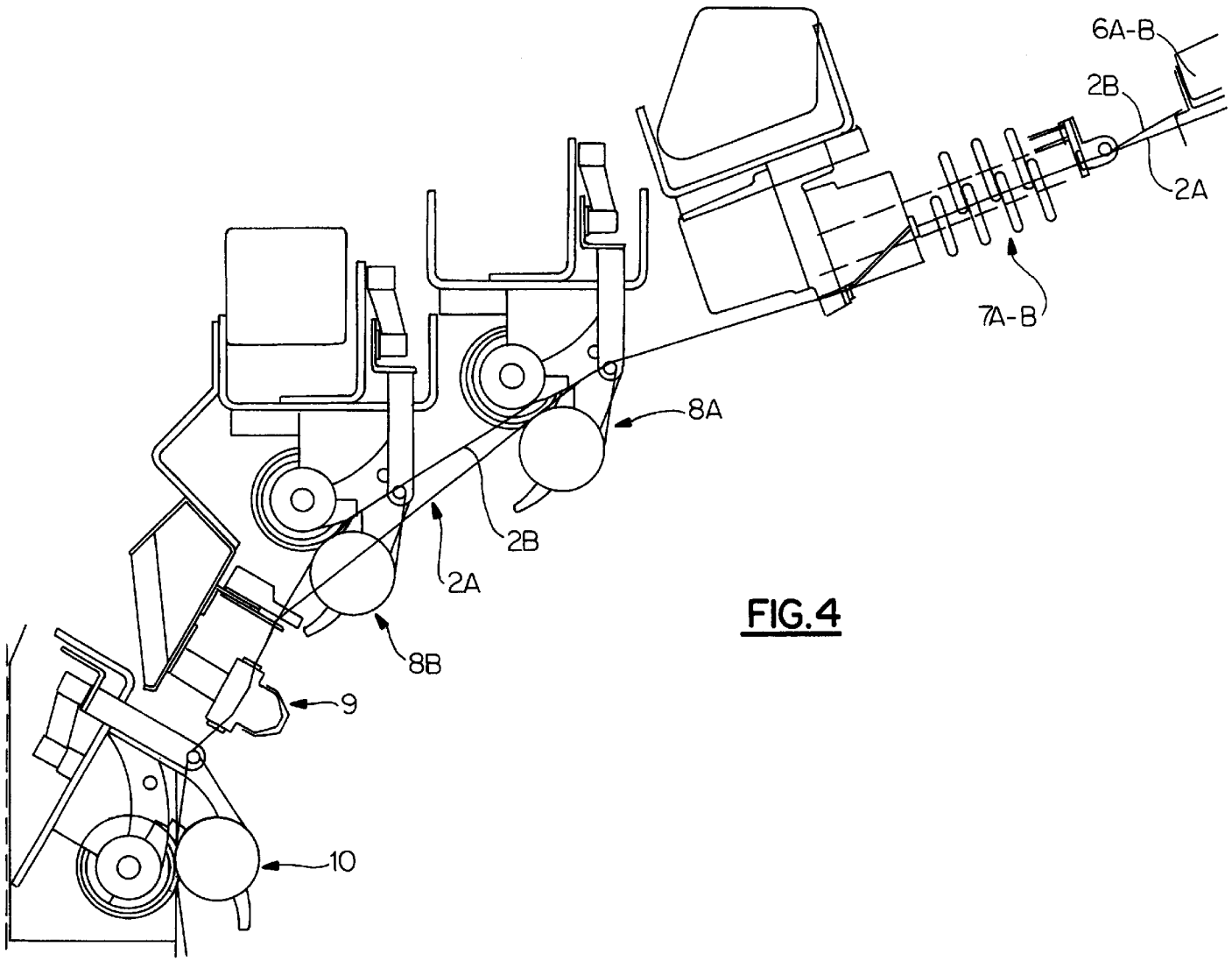
FIG. 4 is a view on a larger scale showing the detail in which the pull-off and the joining of two consecutive yarns is carried out on a machine according to the invention.

Referring to FIGS. 2 and 3, the machine according to the invention which allows production of a composite yarn by assembling two yarns (1A, 1B) textured by false twisting is composed, in a known manner, of a plurality of identical work positions which are placed side by side on a support frame and supplied with yarns (2A, 2B) from length of yarn packages (1A, 1B) mounted on a creel generally reference 30. In the exemplary embodiment illustrated, the machine according to the invention makes it possible to produce eight assembled yarns and therefore comprises sixteen actual texturing positions. obviously, this arrangement is not limiting.

Downstream of the supply creel are therefore placed a plurality of identical work positions, each comprising a false-twist texturing zone followed by a zone enabling the two textured yarns (2A, 2B) to be assembled at two adjacent positions.

For each type of yarn (2A, 2B), the false-twist texturing zone comprises a first forwarder or pull-off (3A, 3B) advantageously mounted near the creel, guide elements (4) enabling the yarn to be transported into a heater (5A, 5B), said heater being followed by a cooling zone (6A, 6B), by a false-twisting spindle (7A, 7B) and by a second pull-off (8A, 8B) for the textured yarn leaving the actual false-twisting zone.

Next, the yarns are transported into the assembling zone intended to bind together two textured yarns from two adjacent positions, this zone essentially consisting of a commingling nozzle (9) and of a third pull-off (10) downstream of which a second heat-treatment zone (12) for the composite yarn (11) is advantageously placed. A fourth pull-off (14), optionally preceded by guide elements, enables the composite yarn to be extracted from the assembling zone in order to transport it to the wind-up means (15).

In accordance with the invention, and as is clearly apparent from the appended figures, the pull-offs (3A, 3B) and (8A, 8B) of the texturing zone are mounted alternately on two parallel shafts 23,24 and 26,27 which are controlled independently of each other.

Moreover, the heat-treatment ovens (6) of the false-twisting zone are temperature-controlled by two systems 28—28 independent of each other and the false-twisting spindles (7) are advantageously motor-driven for example, by variable speed motor 33 enabling the spindle speed to be varied depending on the nature of the yarns.

The joining means (9) for commingling the two yarns are conventional means.

In the embodiment illustrated, the false-twist texturing zone comprises ovens enabling two yarns to be treated in parallel. Consequently, the forwarders (3A, 3B; 8A, 8B) are offset in pairs, the joining zones being offset with respect to the false-twist texturing zones, thus enabling the yarns (2A, 2B) to have identical paths.

Although such a machine can be used for assembling textured yarns obtained from predrawn yarns, it is possible, of course, to carry out the drawing on the machine itself. In such a case, it is possible either to have simultaneous-type drawing or, optionally, to provide drawing means enabling this operation to be carried out between the creel and the first pull-off forwarder, this possibility being illustrated in FIG. 3 by the presence of the drawing systems (20) for the yarns (2B).

As mentioned previously, such a machine can be used not only to produce regular composite yarns but also any type of novelty yarn (loop yarn, slub yarn, etc.) by placing, upstream of the joining zone, equally well before the forwarders placed on the output side of the texturing zone as after them, means making it possible to produce, for example by feeding one yarn at a greater rate than the other, an intermittent delivery rate of one or other yarn, tension variations, which are well known in the art and illustrated schematically at 36 in FIG. 3.

Of course, the invention is not limited to the specific exemplary embodiment illustrated, rather it encompasses all variants thereof which are made in the same spirit.

We claim:

1. Apparatus for the production of a composite yarn created by bringing together lengths of yarn that includes a plurality of identical work stations mounted in a side-by-side orientation upon a common support frame, each work station being arranged to conduct a pair of yarn lengths along independent paths of travel and packages of yarn mounted upon a creel for supplying lengths of yarn into the work stations, each work station further including a false twist texturing unit having a first pull-off means for delivering lengths of yarn through an oven means and then through a cooler means and onto a twisting spindle means, and a second pull-off means positioned downstream from the twisting spindle means for delivering yarn into an assembling unit, said assembling unit for co-joining lengths of false-twisted yarn, said assembling unit containing commingling nozzle means for co-joining the lengths of false twisted yarn in a first work station with lengths of yarn in a second work station, and a third pull-off means for delivering commingling yarn to a heat treatment means and fourth pull-off means for delivering commingled yarn leaving the heat treatment means to a wind up and storage means, wherein said first and second pull-off means are mounted alternatively on two parallel independently controlled shafts.

2. The apparatus of claim 1, wherein said oven means contains adjacent heat treatment units and independent temperature control means for regulating each of the heat treatment units.

3. The apparatus of claim 2 wherein the false twisting spindles are each driven variable speed motors whereby the spindle speed is controlled depending upon the nature of the yarn.

4. The apparatus of claim 1 wherein said commingling means are positioned in the adjacent work stations to permit the lengths of yarn moving through the work stations to move through identical paths of travel before they are commingled.

5. The apparatus of claim 1 wherein said ovens are open ovens to permit two lengths of yarn to be treated in parallel and wherein the first pull-off means in adjacent work stations are offset with regard to adjacent paths of travel.

6. The apparatus of claim 1 that further includes tensioning means for varying the tension of each length of yarn by controlling said pull-off means and control means for permitting temporary accumulation of a selected one of said lengths of yarn.

* * * * *